United States Patent [19]

Holden

[11] 4,150,265

[45] Apr. 17, 1979

[54] HINGE-ACTIVATED SWITCH

[75] Inventor: Dermot Holden, East Brunswick, N.J.

[73] Assignee: Buildex Incorporated, Huntington, N.Y.

[21] Appl. No.: 777,294

[22] Filed: Mar. 14, 1977

[51] Int. Cl.[2] ..... H01H 3/16

[52] U.S. Cl. ..... 200/61.7

[58] Field of Search ..... 200/61.7; 16/186

[56] References Cited

U.S. PATENT DOCUMENTS

| | | | |
|---|---|---|---|
| 3,157,756 | 11/1964 | Close et al. | 200/61.7 |
| 3,803,375 | 4/1974 | Foltz | 200/61.7 |
| 3,840,715 | 10/1974 | Gwozdz | 200/61.7 |
| 4,030,161 | 6/1977 | Loikitz | 16/186 |
| 4,049,934 | 9/1977 | Newlon | 200/61.7 |
| 4,066,857 | 1/1978 | Suska | 200/61.7 |

FOREIGN PATENT DOCUMENTS

| | | | |
|---|---|---|---|
| 1279381 | 6/1972 | United Kingdom | 200/61.7 |
| 1333034 | 10/1973 | United Kingdom | 200/61.7 |

*Primary Examiner*—James R. Scott

*Attorney, Agent, or Firm*—Blum, Moscovitz, Friedman & Kaplan

[57] ABSTRACT

A self-closing hinge with a concealed switch is provided. The hinge has a cam follower formed on a movable member which rides on a cam formed in a stationary member, causing the movable member to move up and down with respect to the stationary member, as the movable member is pivoted about on axis defined by the stationary member. An actuator button mounted in the stationary member abuts a projection on the movable member at a predetermined position of the movable member for actuating a switch assembly concealed within the stationary member. The switch assembly may be used to activate a variety of circuits.

11 Claims, 4 Drawing Figures

HINGE-ACTIVATED SWITCH

BACKGROUND OF THE INVENTION

This invention relates generally to a self-closing hinge and especially to a self-closing hinge having a concealed switch. While such self-closing hinges are known, such as those disclosed in U.S. application Ser. No. 737,138, filed Oct. 29, 1976 now U.S. Pat. No. 4,030,161, having a common assignee, the disclosure of which is incorporated hereby by reference, such hinges have had no provision for mounting a concealed switch assembly which may be use to operate a variety of circuits, such as lights or alarms.

SUMMARY OF THE INVENTION

Generally speaking, in accordance with the invention a self-closing hinge with a concealed switch is provided. The hinge has a movable member for mounting the part to be hinged and a stationary support member for pivotally supporting said movable member. A cam follower on the movable member rides on a cam on the stationary member, causing the movable member to move up and down with respect to the stationary member as the movable member is pivoted. An actuator button mounted in the stationary member abuts a projection on the movable member at a predetermined location in the pivoting of the movable member for actuating a switch assembly concealed within the stationary member. The switch assembly may be used to activate a variety of circuits.

Accordingly, it is an object of this invention to provide a hinge activated switch in which the switch assembly is concealed.

Another object of this invention is to provide a hinge activated switch that is damage and vandel proof.

A further object of this invention is to provide a hinge activated switch that is easy to manufacture, repair and assemble.

Still another object of this invention is to provide a hinge activated switch capable of use wherever a self-closing hinge is usable.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
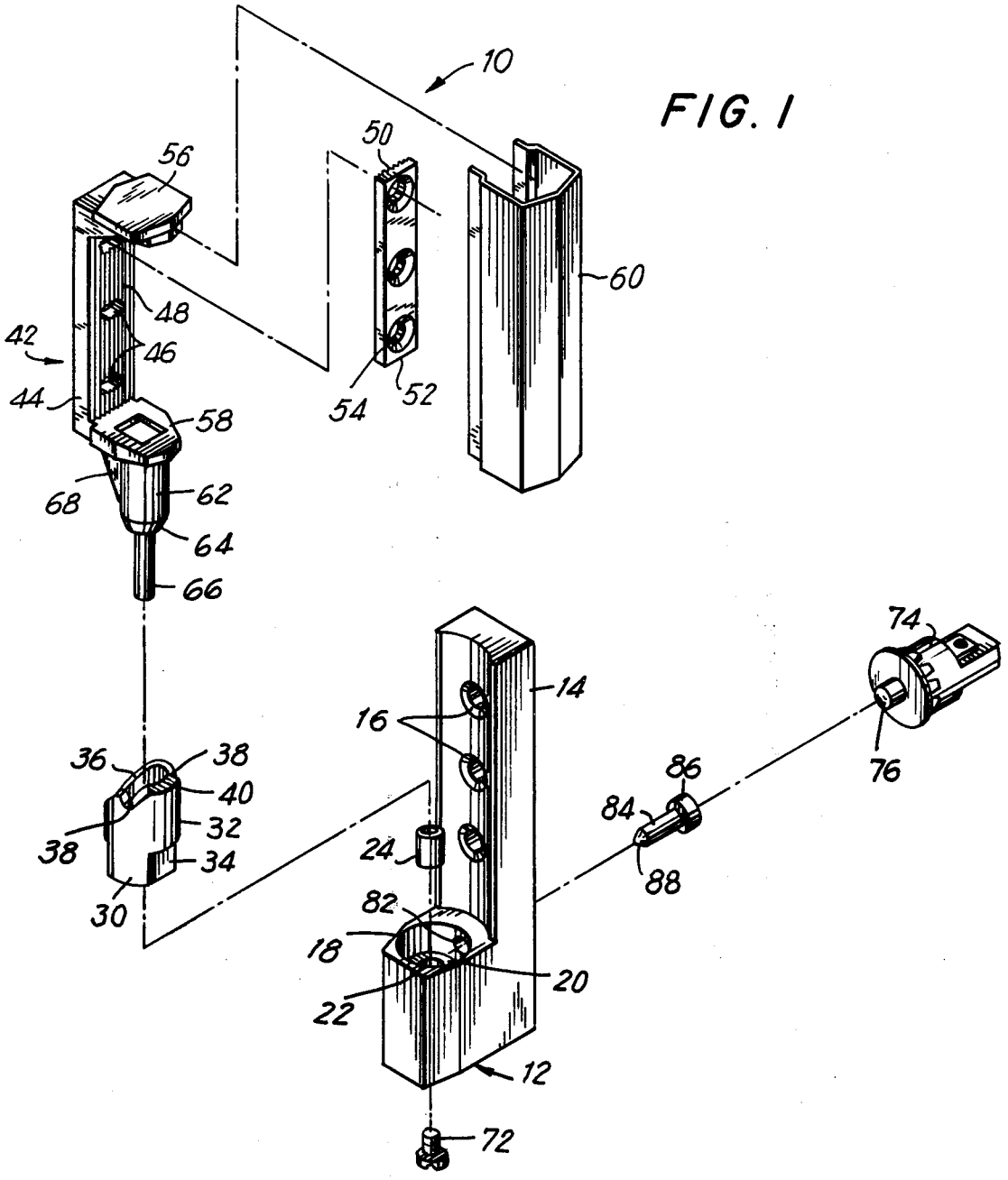
FIG. 1 is an exploded elevational view of a self-closing hinge with a concealed switch constructed in accordance with the preferred embodiment of the instant invention.

A hinge assembly generally indicated at 10 includes a stationary support member 12 formed with an upwardly extending mounting portion 14, by means of which support member 12 is fixedly mounted to a stationary object such as a door frame (not shown). Mounting portion 14 is formed with countersunk bores 16, through which mounting screws may extend for fastening support member 12 to the door frame. Support member 12 is formed with an upwardly directed bore 18 open at its upper end. The lower end of bore 18 terminates in an end wall 19 which extends between the inner wall of bore 18 and an upwardly extending annular sleeve 20 which is integral with support member 12. Annular sleeve 20 defines an axial bore 22 which terminates at its lower end in a further annular end wall 23. Bore 22 is open at its upper end and receives an annular bearing sleeve 24 of a thickness substantially equal to the width of end wall 23. Bearing sleeve 24 and end wall 23 together define an axial bore 28. Support member 12 is also formed with a downwardly projecting bore 26 axially aligned with but of a greater diameter than bore 28.

Support member 12 fixedly carries a stationary cam 32 which is preferably constructed of hard material having a low coefficient of friction, such as nylon. Cam 32 is of tubular construction and is formed with a lower portion 30 dimensioned for receipt in the annular slot defined between bore 18, end wall 19 and sleeve 20. The lower portion 30 of cam 32, which is received in bore 18, has a pair of opposed flats 34 (FIG. 1) which correspond with flat surfaces (not shown) in the lower portion of bore 18, which flats prevents cam 32 from rotating in bore 18. Cam 32 has an upper camming surface 36 which slopes downwardly from a pair of opposed uppermost substantially V-shaped recesses 38 joined by a flat surface 40 (FIG. 1). The balance of camming surface 36 is of a substantially V-shaped configuration, the base of which is orientated in alignment with the door frame and defines the "closed" position of the door. Notches 38 define two "open" positions of the door and are aligned at an angle to the frame.

Hinge assembly 10 also includes a movable member 42 to which the movable object, such as a door, is attached for turning or pivoting movement. Movable member 42 includes a wall 44 adapted to engage the movable part at an edge thereof; wall 42 is formed with a plurality of horizontally extending slots 46 therethrough. The surface of wall 42 extending away from the part to be moved is formed with longitudinally extending serrations 48 which engage corresponding serrations 50 formed on the surface of a plate 52 having countersunk bores 54 formed therethrough. Bores 54 are aligned vertically with slots 46 so that suitable fastening screws (not shown) can extend through these components for the purpose of fixing the movable member 42 to the movable object (door). Serrations 48 and 50 allow the selective lateral positioning of moving member 42 to adjust the seal of the door against the frame. Wall 44 has an upper projecting arm 56 which forms the top end of movable member 42, and a lower projecting arm 58. A cover plate 60 engages upper arm 57 and lower arm 58 and conceals plate 52 and its screws from view. Lower arm 58 is integrally formed with a downwardly extending cylindrical projection 62 whose lower portion 64 is beveled. Cylindrical projection 62 is formed with an axially positioned, cylindrical, downwardly facing socket 63 which receives downwardly projecting pin 66. Cylindrical projection 62 has an integral camming portion 68 which mates with camming surface 36 and which thus is also of a substantially V-shaped configuration. In the closed (lower) position, camming portion 68 has its downwardly directed camming surfaces engaging and mating with the upwardly directed camming surface 36 of cam 32.

Figure 2:
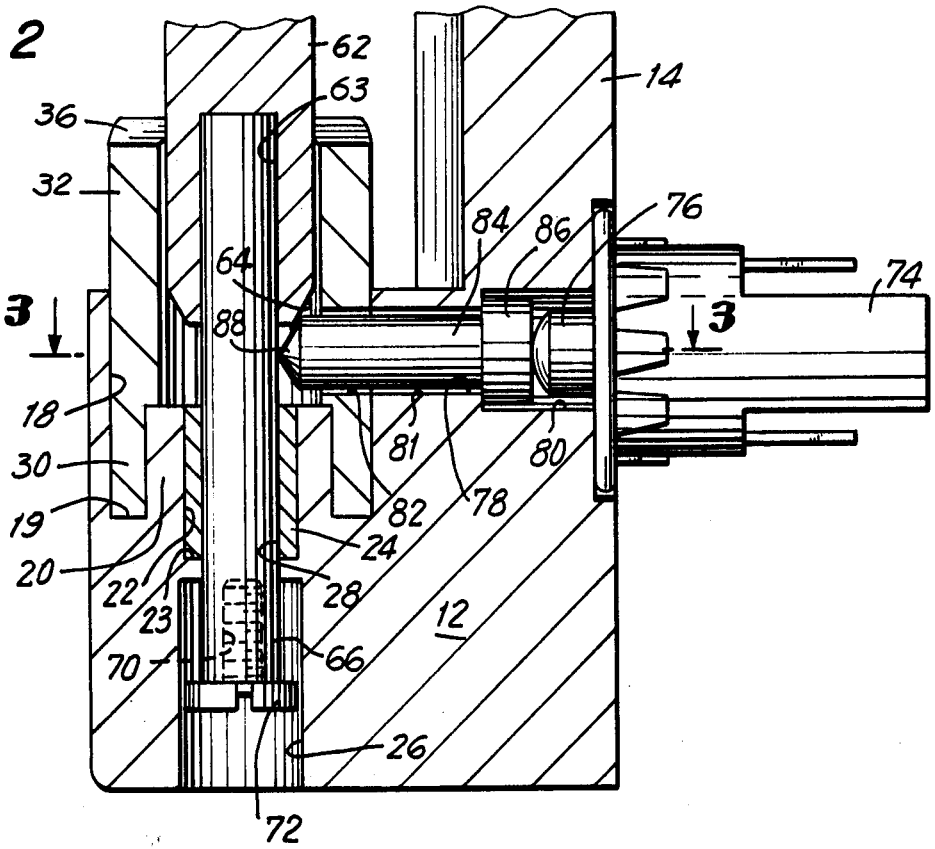
FIG. 2 is a partial sectional elevational view of the assembled hinge assembly with the removable member in an upper, open position.
Figure 4:
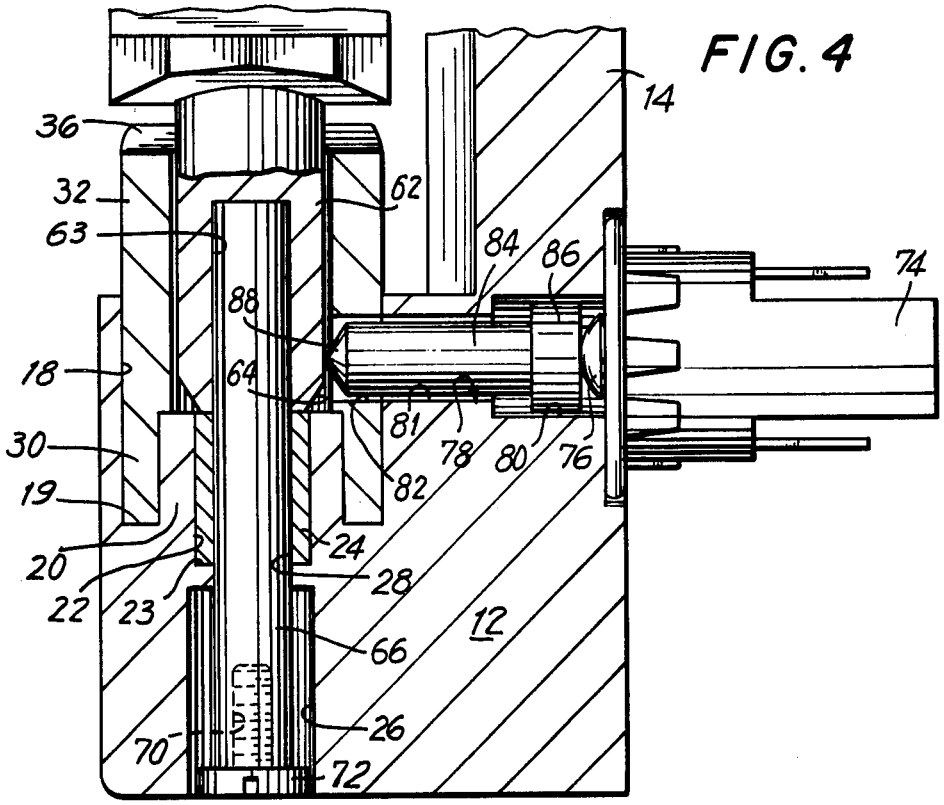
FIG. 4 is a partial sectional elevational view corresponding to FIG. 2, with the movable member in the lowermost position.

When assembled, pin 66 rides in bearing sleeve 24. Pin 66 has a threaded socket 70 at its lower end, and when assembled, a screw 72 in said socket and provided with an enlarged head received within bore 26 but larger in diameter than bore 28, prevents movable member 42 from being removed from stationary support 12, yet allows movable member 42 to rotate in bore 28 and slide along bearing surface 34. As movable means 42 is rotated or pivoted as a door or other movable part attached thereto is opened, its camming portion 68 will ride along upper camming surface 36 of cam 32, thus causing movable member 42 to move upwardly with respect to stationary support means 12. The door may be set in an open position by engaging camming portion 68 with one of V-shaped recesses 38, which will prevent closure until a suitable force is imparted to the door to disengage camming portion 68 from said V-shaped recess 38. As the door is closing, camming portion 68 will ride down the slope of upper camming surface 36. Thus, when the door or other movable object is in a open position, movable member 42 will be in an upper position, as shown in FIG. 2. Conversely, when the door or other movable object is in a closed position, movable member 42 will be in a lower position, as shown in FIG. 4.

Figure 3:
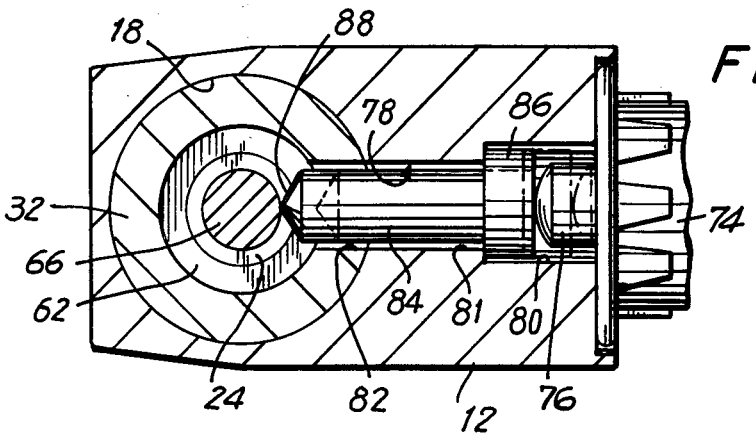
FIG. 3 is a partial sectional view taken along line 3—3 of FIG. 2, with the actuator button corresponding to a lower, closed position of the movable member shown in phantom lines.

Mounted on stationary support member 12 is a switch assembly 74, similar to the type used to actuate dome lights in automobiles, that is, when the switch button 76 is depressed, the circuit is opened. A horizontally extending bore 78 is formed in stationary support member 12 has an enlarged outer portion 80 and a narrower portion 81 which communicates with a corresponding bore 82 in cam 32. Slidably mounted in bore 78 is an actuator pin 84 which has an enlarged portion 86 riding in outer bore portion 80 and abutting switch button 76. Actuator pin 84 is formed with a conical tip 88 abutting beveled end 64 of cylindrical projection 62. Thus, when movable member 14 is in an upper position corresponding to an open door, as shown in FIG. 2, actuator pin 76 of switch assembly 76 will be displaced to the left as viewed in FIGS. 2, 3 and 4 by the force of the spring activity on switch button 76 within switch assembly 74. When movable member 42 is in its lowermost position, corresponding to a closed door, as shown in FIG. 4, the camming action of beveled portion 64 of cylindrical projection 62 upon conical tip 88 of actuator pin 84 will cause the pin to slide in the direction toward switch assembly 74, causing switch button 76 to be depressed and the circuit to be opened.

Switch assembly 74 is mounted within a recess formed in the door frame and hidden from view. This arrangement provides a secure, damage- and vandel-proof mounting for the switch. Such a switch is suitable for use as the light switch for an appliance such as a refrigerator. Additionally, such a location is especially suitable for a switch which activates an alarm circuit to indicate that a door has been opened. Indeed, when the mounting of the instant invention is used, it would not be possible to tell that a switch has even been activated since no portion of the switch mechanism is visible.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

What is claimed is:

1. A hinge activated switch assembly for pivotably disposing a door with respect to a door frame comprising a fixed member mounted to said door frame, a pivotable member secured to said door and disposed for pivotable displacement with respect to said fixed member, axial displacing means at least in part coupling said pivotable member and said fixed member for displacing said pivotable member with respect to said fixed member along the axis of pivot of said pivotable member during and in response to the pivotable displacement of said pivotable member when said door is pivoted, switch means, and switch actuating means operatively coupled to said pivotable member, and mounted for displacement in response to the axial displacement of said pivotable member to actuate said switch means upon said axial and pivotable displacement of said pivotable member.

2. The hinge activated switch assembly as claimed in claim 1 wherein said axial displacement means comprise cam means.

3. The hinge activated switch as claimed in claim 2, wherein said cam means comprises a fixed cam disposed on said fixed member and a cam follower disposed on said pivotable member.

4. The hinge activated switch assembly as claimed in claim 2, wherein said cam means is coaxial with the axis of rotation of said pivotable member.

5. The hinge activated switch assembly as claimed in claim 4, wherein said cam means comprise a cylindrical fixed cam having a substantially V-shaped camming surface and said cam follower has a corresponding V-shaped projection for engagement with said fixed cam.

6. The hinge activated switch assembly as claimed in claim 5, wherein said camming surface includes at least one notch on at least one side of said V-shaped camming surface defining an open position when engaged by said cam follower.

7. The hinge activated switch assembly as claimed in claim 1, wherein said switch means is disposed on said fixed member.

8. The hinge activated switch assembly as claimed in claim 7, wherein said switch means is mounted within said fixed member so as to conceal said switch means from view.

9. The hinge activated switch assembly as claimed in claim 1, wherein said fixed member includes a body portion formed with a bore therein aligned with the axis of pivoting of said pivotable member, said pivotable member having an axial projecting portion extending into said axial bore, said fixed member body having a further bore extending laterally to and communicating with said axial bore, said switch actuating means including button means mounted for axial displacement in said lateral bore and means biasing said button means into said axial bore, said pivotable member axial projecting portion having a camming surface for engaging and displacing said button means away from the axis of said axial bore as said axial projecting portion is axially displaced in said axial bore by said cam means in response to the pivoting of said pivotable member to activate said switch means.

10. The hinge actuated switch assembly as claimed in claim 9, wherein said axial displacement means comprises a fixed cam disposed on said fixed member and a cam follower disposed on said pivotable member, said fixed cam being in the form of a cylinder having a camming surface for engagement with said cam follower on one side thereof, said fixed cam being received within said axial bore.

11. The hinge activated switch assembly as claimed in claim 9, wherein said switch means and button means are not normally visible when said hinge is assembled and in use.

* * * * *